US008408678B2

(12) United States Patent
Chida et al.

(10) Patent No.: US 8,408,678 B2
(45) Date of Patent: Apr. 2, 2013

(54) LIQUID EJECTION HEAD AND METHOD FOR PRODUCING THE SAME

(75) Inventors: Mitsuru Chida, Yokohama (JP); Jun Yamamuro, Yokohama (JP); Kenji Fujii, Yokohama (JP); Tetsuro Honda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 103 days.

(21) Appl. No.: 13/188,211

(22) Filed: Jul. 21, 2011

(65) Prior Publication Data

US 2012/0026246 A1 Feb. 2, 2012

(30) Foreign Application Priority Data

Jul. 27, 2010 (JP) ..... 2010-168044

(51) Int. Cl.
*B41J 2/135* (2006.01)

(52) U.S. Cl. ..... 347/44; 347/65; 347/71

(58) Field of Classification Search ..... 347/20, 347/40, 42–44, 54, 56, 61, 65–72
See application file for complete search history.

(56) References Cited

U.S. PATENT DOCUMENTS 7,384,128 B2 * 6/2008 Sheahan et al. ..... 347/42

FOREIGN PATENT DOCUMENTS

JP 11-348290 A 12/1999
JP 2009-274266 A 11/2009

* cited by examiner

*Primary Examiner* — Thinh Nguyen
(74) *Attorney, Agent, or Firm* — Canon USA Inc IP Division

(57) ABSTRACT

A liquid ejection head includes a substrate having an energy-generating device configured to generate energy used for ejecting a liquid from an orifice; a transparent channel wall member forming an inner wall of a channel leading to the orifice; and an intermediate layer disposed between and in contact with a surface of the substrate and the channel wall member and having a refractive index different from a refractive index of the channel wall member. The intermediate layer has a first outer end surface forming contours of a symbol as viewed in a direction from the orifice toward the substrate and making a first angle with the surface of the substrate and a second outer end surface facing the channel and making a second angle with the surface of the substrate. The first angle is an obtuse angle. The second angle is smaller than the first angle.

11 Claims, 7 Drawing Sheets

FIG. 4A1
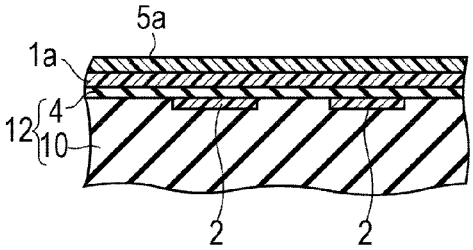
FIG. 4A2
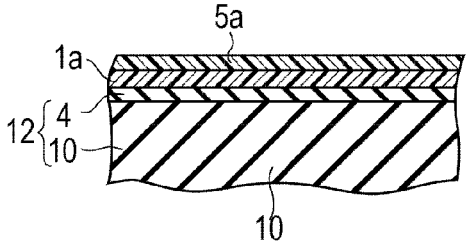
FIG. 4B1
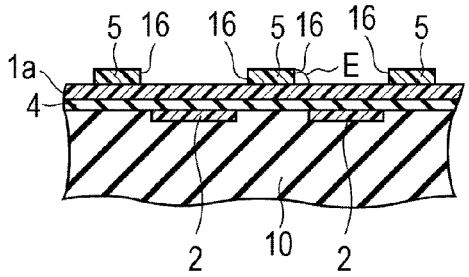
FIG. 4B2
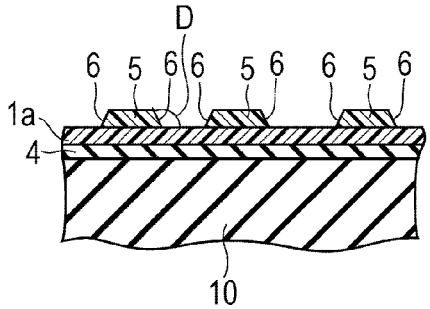
FIG. 4C1
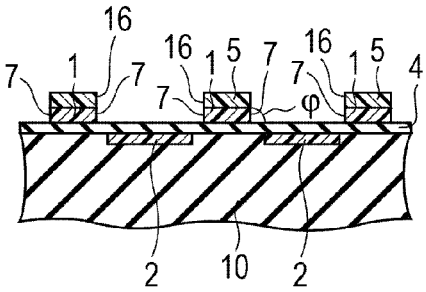
FIG. 4C2
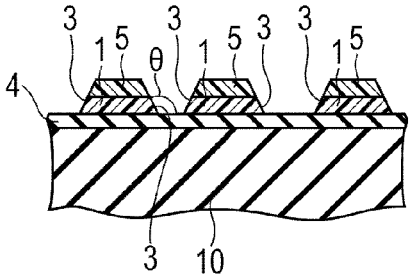
FIG. 4D1
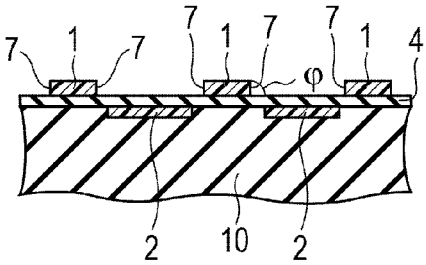
FIG. 4D2
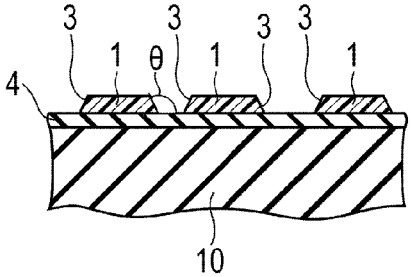

LIQUID EJECTION HEAD AND METHOD FOR PRODUCING THE SAME

BACKGROUND OF THE INVENTION

1. Field of the Invention

The present invention relates to liquid ejection heads and methods for producing liquid ejection heads.

2. Description of the Related Art

A typical example of a liquid ejection head for ejecting a liquid is an inkjet recording head applied to an inkjet recording system for ejecting ink onto a recording medium to perform recording. An inkjet recording head usually includes ink channels, ejection energy generators provided in parts of the channels, and fine ink orifices for ejecting ink by the energy generated by the ejection-energy generators.

To improve adhesion between a substrate having energy-generating devices and a member forming walls of liquid channels, Japanese Patent Laid-Open No. 11-348290 discloses a technique in which the substrate and the member forming walls of channels are bonded with an intermediate layer, formed of polyetheramide, disposed therebetween.

Japanese Patent Laid-Open No. 2009-274266, on the other hand, discloses a method in which a blank pattern of characters corresponding to information about the history of an inkjet recording head is formed in an intermediate layer disposed between a substrate having energy generators and walls of liquid channels so as to follow the walls of the channels.

Recently, the pattern of channels has become increasingly finer, and an intermediate layer having a finer corresponding pattern needs to be formed. The intermediate layer can be formed such that end surfaces thereof are substantially perpendicular, or close to being perpendicular, to the surface of the substrate in view of, for example, constraints on the positional relationship between the intermediate layer and the member forming the channel walls and the contact area between the intermediate layer and the member forming the channel walls.

However, if a blank pattern is formed in the intermediate layer to display information about the inkjet recording head, as disclosed in Japanese Patent Laid-Open No. 2009-274266, it may be difficult to visually recognize the contours of the information display pattern, and it may therefore be difficult to identify the pattern, depending on the transparency of the layer overlying the intermediate layer.

SUMMARY OF THE INVENTION

Accordingly, the present invention provides a liquid ejection head that is reliable, easy to identify, and simple in structure in which a layer formed in a pattern corresponding to channel walls with high precision and having a symbol display pattern that is easy to recognize is disposed between the substrate and the channel walls, and also provides a method for producing such a liquid ejection head with high yield.

A liquid ejection head according to an aspect of the present invention includes a substrate having an energy-generating device configured to generate energy used for ejecting a liquid from an orifice; a transparent channel wall member forming an inner wall of a channel leading to the orifice; and an intermediate layer disposed between and in contact with a surface of the substrate and the channel wall member and having a refractive index different from a refractive index of the channel wall member. The intermediate layer has a first outer end surface forming contours of a symbol as viewed in a direction from the orifice toward the substrate and making a first angle with the surface of the substrate and a second outer end surface facing the channel and making a second angle with the surface of the substrate. The first angle is an obtuse angle. The second angle is smaller than the first angle.

Further features of the present invention will become apparent from the following description of exemplary embodiments with reference to the attached drawings.

BRIEF DESCRIPTION OF THE DRAWINGS

FIGS. 4A1 to 4D1 and 4A2 to 4D2 are schematic diagrams illustrating a second embodiment of the present invention.

DESCRIPTION OF THE EMBODIMENTS

Embodiments of the present invention will now be described with reference to the drawings.

Liquid ejection heads (hereinafter "heads") according to embodiments of the present invention can be mounted on devices such as printers, copiers, fax machines with a communications system, word processors with a printer section, and industrial recording apparatuses incorporating various types of processors. Liquid ejection heads according to embodiments of the present invention can also be used in applications such as fabrication of biochips, printing of electronic circuits, and spraying of chemicals.

Figure 1A:
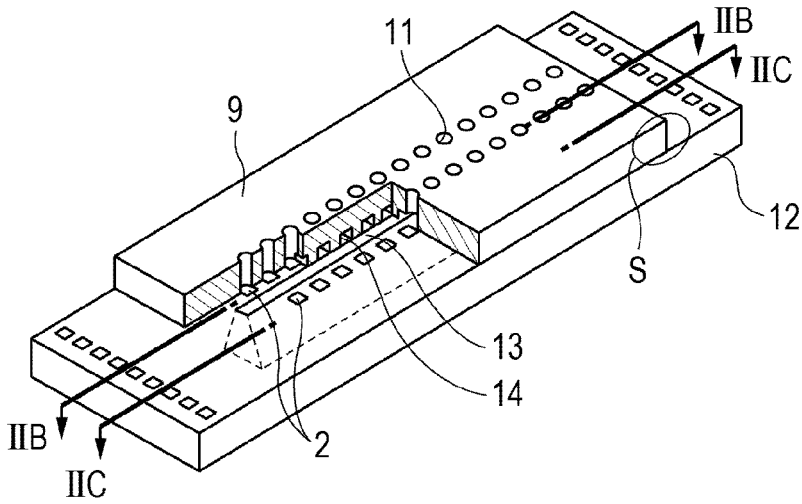
FIGS. 1A and 1B are schematic perspective views of liquid ejection heads according to an embodiment of the present invention.

FIG. 1A is a partially cutaway perspective view of a liquid ejection head according to an embodiment of the present invention shown in chip form after cutting. The liquid ejection head according to this embodiment includes a silicon substrate 12 on which energy-generating devices 2 configured to generate energy used for ejecting ink are arranged at a predetermined pitch in two rows side by side. The substrate 12 has a common supply port 13 between the two rows of energy-generating devices 2. A channel wall member 9 forming inner channel walls on the substrate 12 has orifices 11 located above the energy-generating devices 2 and channels 14 leading from the common supply port 13 to the orifices 11. The surface in which the orifices 11 are formed may have a liquid-repellent finish.

This head is disposed such that the surface in which the common supply port 13 is formed faces a recording surface of a recording medium. The head applies pressure generated by the energy-generating devices 2 to a liquid, such as ink, charged into the channels 14 through the common supply port 13 to eject the liquid from the orifices 11 as droplets onto a recording medium such as paper, thus performing recording.

Figure 1B:
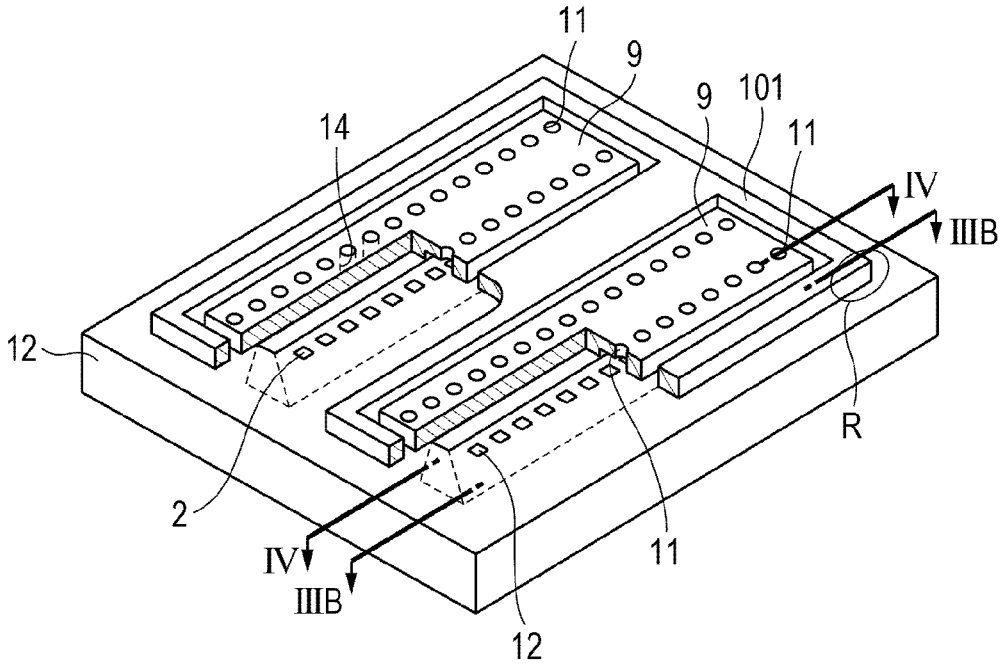

In another example shown in FIG. 1B, a surrounding member 101 surrounds the periphery of the channel wall member 9. If the channel wall member 9 is formed of a cured resin, the surrounding member 101 may be formed of the same cured resin. For example, if the surrounding member 101 has substantially the same height as the channel wall member 9, it provides advantages such as improved wiping properties and improved protection for the device surface of the substrate 12.

An information symbol region S (FIG. 1A; R (FIG. 1B)) disposed near an end of the liquid ejection head has a symbol pattern corresponding to information about the liquid ejection head.

First Embodiment

Figure 2A:
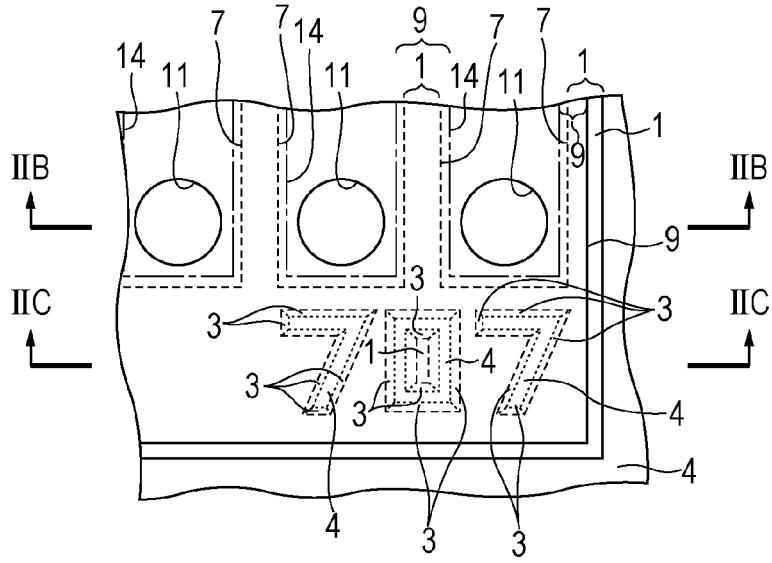
FIGS. 2A to 2C are schematic diagrams illustrating a first embodiment of the present invention.
Figure 2B:
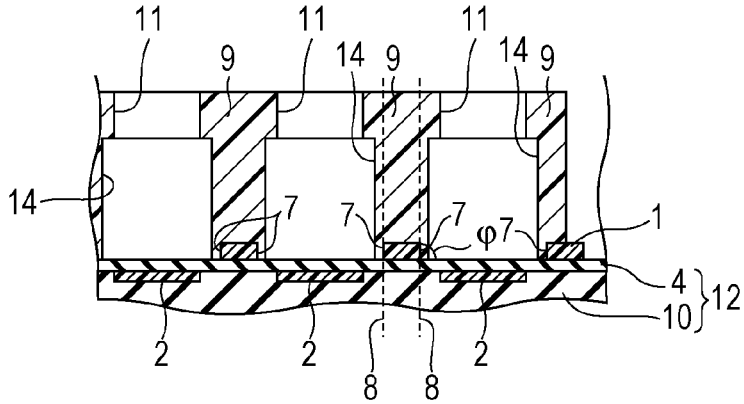
Figure 2C:
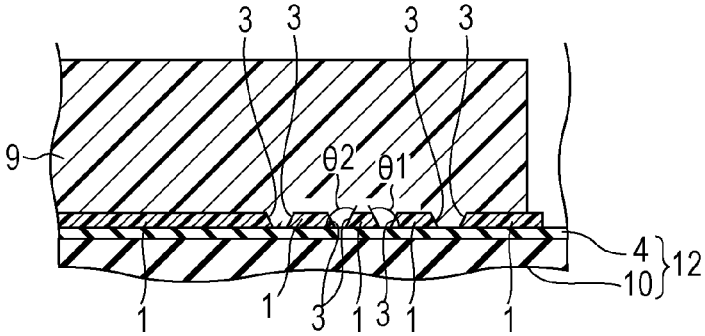
Figure 3A:
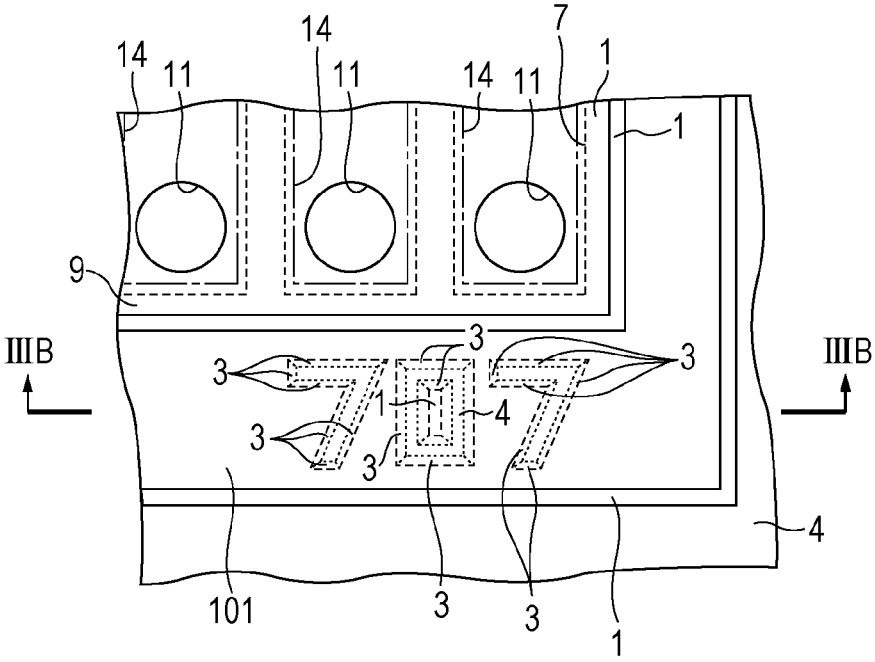
FIGS. 3A and 3B are schematic diagrams illustrating the first embodiment of the present invention.
Figure 3B:
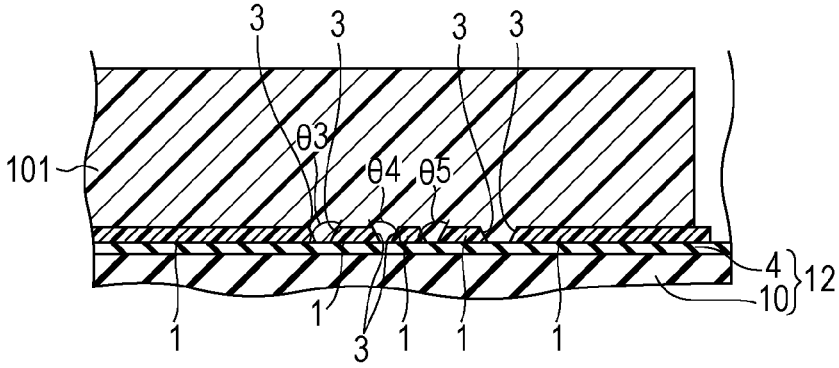

FIGS. 2A to 2C and FIGS. 3A and 3B are schematic diagrams illustrating heads according to a first embodiment of the present invention. FIG. 2A is an enlarged view of the top of the head shown in FIG. 1A in and around the information symbol region S. FIG. 2B is a sectional view of the liquid ejection head taken in a plane perpendicular to the substrate 12 along line IIB-IIB of FIGS. 1A and 2A as viewed in the direction from the outside toward the inside of the liquid ejection head. FIG. 2C is a sectional view of the liquid ejection head taken in a plane perpendicular to the substrate 12 along line IIC-IIC of FIGS. 1A and 2A as viewed in the direction from the outside toward the inside of the liquid ejection head. FIG. 3A is an enlarged view of the top of the head shown in FIG. 1B in and around the information symbol region R. FIG. 3B is a sectional view of the liquid ejection head taken in a plane perpendicular to the substrate 12 along line IIIB-IIIB of FIGS. 1B and 3A as viewed in the direction from the outside toward the inside of the liquid ejection head.

As shown in FIG. 2B, the substrate 12 includes a base 10 and a surface layer 4, such as an insulating layer (e.g., SiN or SiC) or an anticavitation layer (e.g. tantalum), covering the energy-generating devices 2, which are formed of a heat-generating resistor such as TaSiN. The surface layer 4 forms the surface of the substrate 12. An intermediate layer 1 is disposed between and in contact with the surface of the substrate 12 and the channel wall member 9. Although the intermediate layer 1 is not exposed in the channels 14 in the example shown, the intermediate layer 1 may be exposed in the channels 14. If the surface layer 4 forming the surface of the substrate 12 is formed of an inorganic material and the channel wall member 9 is formed of a resin such as cured epoxy resin or polyimide, the intermediate layer 1 may be formed of polyimide or polyetheramide to provide good adhesion between the surface layer 4 and the channel wall member 9. The second angle $\phi$ of second corners between second outer end surfaces 7 of the intermediate layer 1 and the surface of the substrate 12 is smaller than the first angle $\theta$ of first corners between first outer end surfaces 3, described later, and the surface of the substrate 12. The second angle $\phi$ between the second outer end surfaces 7 and the surface of the substrate 12 may be 85° to less than 100° in view of channel design. For example, if the intermediate layer 1 is formed of a material contributing to improved adhesion between the channel wall member 9 and the substrate 12 and the ends 8 of the region where the intermediate layer 1 is disposed are determined, the sum of the contact area between the intermediate layer 1 and the surface of the substrate 12 and the contact area between the intermediate layer 1 and the channel wall member 9 can be made larger under those conditions. If the second angle $\phi$ is 85° to less than 90°, the intermediate layer 1 has an overhang shape, which can be formed by forming the portions of the intermediate layer 1 corresponding to the second outer end surfaces 7 using a lift-off process, or by forming the intermediate layer 1 using a negative photoresist and adjusting the focal position during pattern exposure. Alternatively, the overhang shape can be formed by isotropic etching using a resist mask. The thickness of the intermediate layer 1 may be, but is not limited to, 0.5 to 10 μm, and if the thickness is 1 to 5 μm, it can be formed with more ease and less stress.

As shown in FIG. 2C, on the other hand, the first outer end surfaces 3 of the intermediate layer 1 make first angles $\theta$1, $\theta$2, and $\theta$n with the surface of the substrate 12. The first angles $\theta$1, $\theta$2, and $\theta$n are obtuse angles and may be different.

As shown in FIG. 2A, as the liquid ejection head is viewed in the direction from the orifices 11 toward the substrate 12, the first outer end surfaces 3 form the contours of symbols corresponding to information about the liquid ejection head. The regions on the surface of the substrate 12 that are not covered by the intermediate layer 1, that are surrounded by the first outer end surfaces 3, and that are in contact with the channel wall member 9 have the shapes of the symbols corresponding to the information about the liquid ejection head. The channel wall member 9 and the intermediate layer 1 have different refractive indices so that the contours of the intermediate layer 1 can be recognized. In FIG. 3A, as an example of the symbols, the successive first outer end surfaces 3 form the contours of the numbers "7", "0", and "7", which can be recognized as the three-digit number "707".

The contours of the intermediate layer 1 can be recognized by optically sensing the edges of the intermediate layer 1 through the channel wall member 9, which is transparent, from the channel wall member 9 side, for example, visually or using a sensor. In this case, the second outer end surfaces 7, which face the channels 14 and make the second angle $\phi$, can be recognized as the contours of the intermediate layer 1. The contours of the intermediate layer 1 formed by the first outer end surfaces 3 used for information display, on the other hand, are easier to recognize because the first outer end surfaces 3 have a larger optically sensible range since the first angle $\theta$ is larger than the second angle $\phi$. In other words, whereas the second outer end surfaces 7 of the intermediate layer 1 are nearly perpendicular to the surface of the substrate 12, the first outer end surfaces 3 are inclined. The first outer end surfaces 3, which are inclined surfaces, are easier to optically sense from above, particularly to visually sense, than nearly perpendicular surfaces. Accordingly, the symbols corresponding to the information about the liquid ejection head can be easily recognized. The first angle $\theta$ may be 100° to 115°. If the first angle $\theta$ is 100° or more, the first outer end surfaces 3 can be optically more easily recognized. If the first angle $\theta$ is 115° or less, the slopes are moderately wide so that it is easier to find where they start (the top surface of the intermediate layer 1) and where they end (the boundary between the first outer end surfaces 3 and the surface of the substrate 12). Another advantage of the first outer end surfaces 3 being inclined is that it is easier to find the boundaries between the surface of the substrate 12 and the intermediate layer 1 when trying to recognize as symbols the contours of the regions on the surface of the substrate 12 that are surrounded by the first outer end surfaces 3 and that are in contact with the channel wall member 9. The channel wall member 9 may be formed of a resin such as epoxy resin or polyimide or an inorganic compound such as silicon nitride or silicon oxide. The intermediate layer 1 may be formed of a thermoplastic resin such as polyimide or polyetheramide or an inorganic compound such as silicon nitride, silicon oxide, or silicon carbide.

In the example including the surrounding member 101, as shown in FIGS. 3A and 3B, the information symbol region including the first outer end surfaces 3 may be provided in the region of the intermediate layer 1 between the surrounding member 101 and the surface of the substrate 12. The first outer end surfaces 3 forming the contours of the symbols may also be provided both below the channel wall member 9 and below the surrounding member 101.

Figure 6A:
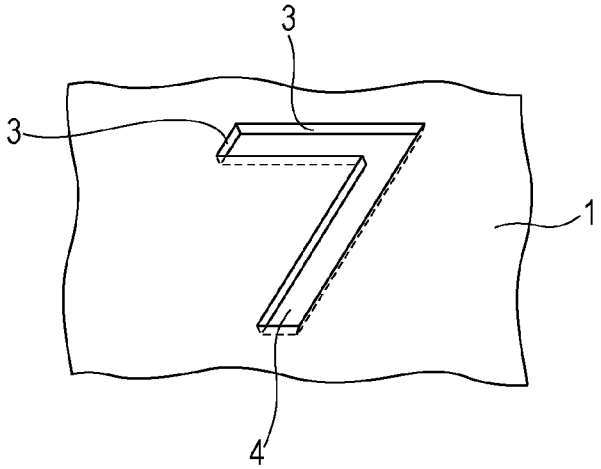
FIGS. 6A and 6B are schematic diagrams illustrating the first embodiment of the present invention.
Figure 6B:
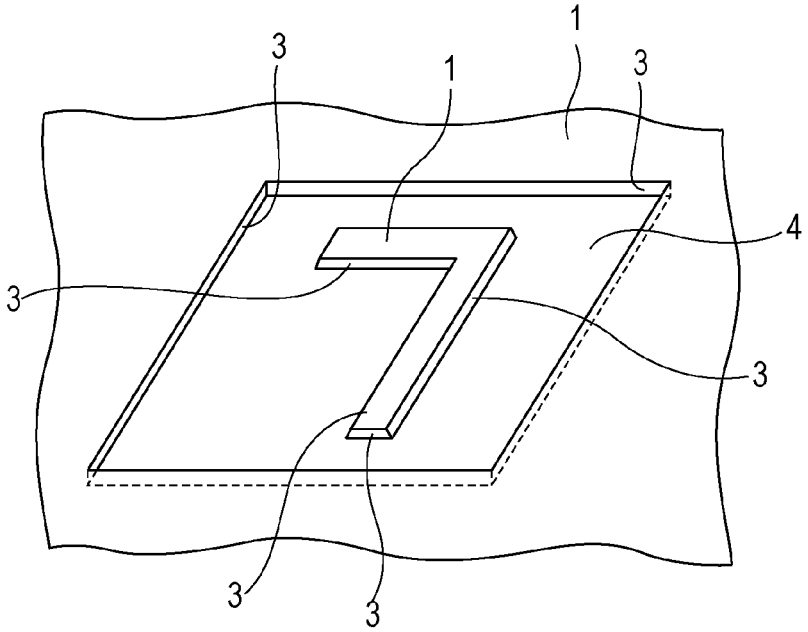

In the examples described above, as shown in FIG. 6A, the blank pattern of the intermediate layer 1 has the shape of the Arabic numeral "7"; instead, as shown in FIG. 6B, the remaining pattern of the intermediate layer 1 may have the shape of the Arabic numeral "7".

In addition, the characters are not limited to numbers, but may be a mixture of numbers and letters, such as "E", "1", and "1", or may be only letters. Furthermore, the numbers are not limited to Arabic numerals, but may be Roman numerals or Chinese numerals. The characters may be read either by visual recognition by the human using a microscope with appropriately adjusted magnification and focus or by machine recognition. Visual recognition by the human requires no special reader and allows determination with allowance for slight errors in the contours of the characters. The characters may also be recognized from information obtained using a device capable of acquiring contour information by measuring the contrast between the channel wall member 9 and the intermediate layer 1 using light other than visible light. In this case, the channel wall member 9 may have light absorption/reflection properties that do not interfere with measurement on light of any wavelength used for the measurement.

Figure 7:
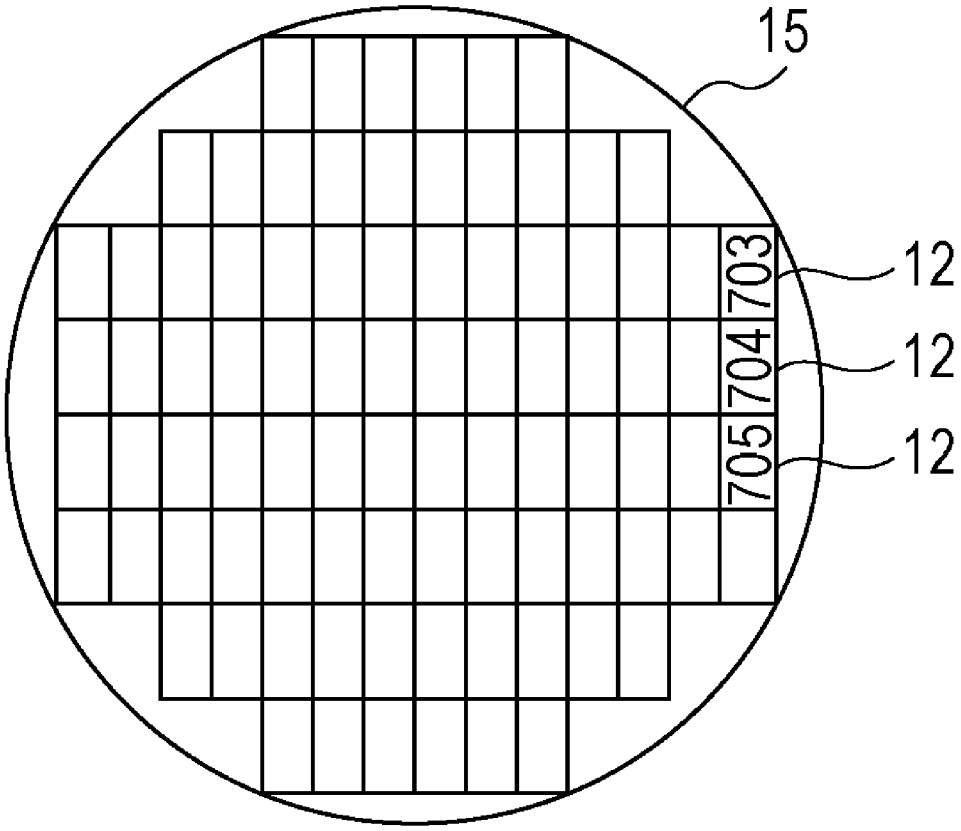
FIG. 7 is a schematic diagram illustrating the first embodiment of the present invention.

The information symbol region S or R contains information corresponding to the information about the liquid ejection head determined in advance before the channel wall member 9 is disposed on the intermediate layer 1. One example is history information. For example, liquid ejection heads are produced by forming channels and orifices in a wafer about 8 inches in diameter and cutting it into liquid ejection head chips. For example, as shown in FIG. 7, the numbers formed by the outer end surfaces 3 indicate where the substrates 12 are located in the wafer 15 before the wafer 15 is cut into chips. The wafer 15 can be cut between the first outer end surfaces 3 of the adjacent chips.

It is determined in advance before the formation of the channel wall members 9 where the individual channel wall members 9 are to be formed on the wafer, and this information is stored as the information about the liquid ejection heads in the form of characters. This information can be read from the separated liquid ejection heads to check the positions of the substrates 12 in the wafer after the cutting. Based on this information, the production process can be reviewed for improvement. For example, the condition of a photomask during exposure in the formation of the channel wall member 9 can be reviewed. The symbols may be any symbols, such as ones corresponding to the information about the liquid ejection heads. Examples of the information about the liquid ejection heads include identification information for the individual liquid ejection heads, identification information for the exposure mask used for formation of the channel wall members 9, information about the date and time of production or the place of production, and information about the number of products. Such information, which is determined before the formation of the channel wall members 9, can be displayed as characters by the outer end surfaces 3 forming the contours of the corresponding characters.

In the examples described above, the first outer end surfaces 3 forming the shapes of characters are used as characters to provide the liquid ejection head with information corresponding to the information about the liquid ejection head. The shapes formed by the first outer end surfaces 3, however, are not limited to characters, but may be any symbols or marks that can be recognized in a broad sense, and they can be associated with the information about the liquid ejection head. For example, the first outer end surfaces 3 can form a symbol such as the "at sign" symbol on keyboards or the "club" symbol on playing cards. As with characters, as described above, such symbols can be associated with predetermined information about the liquid ejection head, and the first outer end surfaces 3 forming the contours of those symbols can be formed on the liquid ejection head. Examples of symbols include characters and signs used in academic fields such as mathematics and physics, art fields such as music and fine art, and other fields such as architecture, accounting, road traffic, and commerce. In addition, even shapes that are generally not recognized or used as symbols related to some kinds of events can be used as symbols by defining the correspondences between those shapes and information about liquid ejection heads. Depending on the information to which the symbols correspond, the first outer end surfaces 3 can be provided either so as to form the contours of the same symbol on all liquid ejection head units in a wafer or so as to form different symbols, such as first, second, third, and n-th symbols, on the liquid ejection heads.

Second Embodiment

An example of a method for producing a liquid ejection head will now be described as a second embodiment.

FIGS. 4A1 to 4D1 and 4A2 to 4D2 are schematic sectional views showing the method for producing a liquid ejection head according to the second embodiment. FIGS. 4A1 to 4D1 are schematic sectional views, showing the individual steps, taken in a plane perpendicular to the substrate 12 along line IIB-IIB of FIG. 1A and line IV-IV of FIG. 1B. FIGS. 4A2 to 4D2 are schematic sectional views, showing the individual steps, taken in a plane perpendicular to the substrate 12 along line IIC-IIC of FIG. 1A and line IIIB-IIIB of FIG. 1B.

Referring to FIG. 4A1, the silicon substrate 12 has the energy-generating devices 2 configured to generate energy used for ejecting a liquid. As shown in FIGS. 4A1 and 4A2, the surface layer 4 forming the surface of the substrate 12, an intermediate material layer 1*a* used for forming the intermediate layer 1, and a mask material layer 5*a* used as an etching mask for etching the intermediate material layer 1*a* are stacked on the silicon substrate 12 in the above order.

Referring then to FIGS. 4B1 and 4B2, the mask material layer 5*a* is patterned to form an etching mask 5 for etching the intermediate material layer 1*a*. As shown in FIG. 4B1, the fourth angle E between the intermediate material layer 1*a* and fourth outer end surfaces 16 of the etching mask 5 opposite the regions corresponding to the channels is nearly a right angle. As shown in FIG. 4B2, on the other hand, the angle D between the intermediate material layer 1*a* and third outer end surfaces 6 of the etching mask 5 in the region corresponding to the information sign region is an obtuse angle. The angle E is smaller than the angle D. The fourth outer end surfaces 16 correspond to the second outer end surfaces 7, whereas the third outer end surfaces 6 correspond to the first outer end surfaces 3. The third outer end surfaces 6 can be formed by forming the mask material layer 5*a* using a positive photoresist and exposing the top of the mask material layer 5*a* to diffracted light to the region inside the mask on the basis of the gap between the mask and the photoresist in proximity exposure. The third outer end surfaces 6 can also be formed by adjusting the focal position in reduction projection exposure so that they make the obtuse angle D with the surface of the substrate 12.

Figure 5:
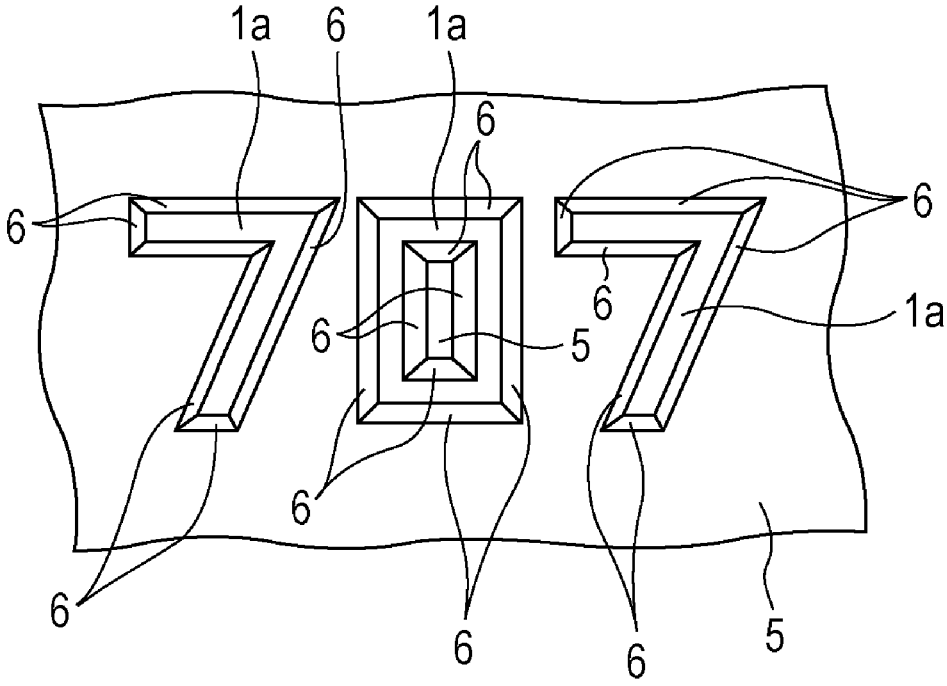
FIG. 5 is a schematic diagram illustrating the second embodiment of the present invention.

FIG. 5 shows the etching mask 5 shown in FIG. 4B2 as viewed from thereabove toward the substrate 12. As the top surface of the etching mask 5 is viewed in the direction toward the substrate 12, the intermediate material layer 1*a* is exposed so as to be surrounded by the third outer end surfaces 6, which form the contours of the symbols corresponding to the information about the liquid ejection head and which make the third angle, which is an obtuse angle, with the surface of the substrate 12. Different symbols may also be assigned to liquid ejection head segments. In this case, outer end surfaces forming the contours of different symbols are formed on the etching mask 5 using a full-field exposure apparatus.

Referring then to FIGS. 4C1 and 4C2, the intermediate material layer 1*a* is etched using the etching mask 5 to form the intermediate layer 1, which has the first outer end surfaces 3 and the second outer end surfaces 7, on the surface of the substrate 12.

Referring then to FIGS. 4D1 and 4D2, the mask 5 is removed.

Afterwards, the channel wall member 9 is formed on the intermediate layer 1 to form the channels as shown in FIG. 2B and the information symbol region as shown in FIG. 2C or 3B.

The present invention will now be specifically described with reference to the examples below.

EXAMPLE 1

First, a substantially circular wafer-shaped silicon substrate 12 was prepared on which a plurality of energy-generating devices 2 (material: TaSiN) and a plurality of drivers and logic circuits (not shown) were arranged and on which an SiN surface layer 4 was formed. The surface layer 4 was then coated with polyetheramide (HIMAL (trade name) available from Hitachi Chemical Co., Ltd.) at a thickness of 2 μm by spin coating and was baked in an oven at 100° C. for 30 minutes and then at 250° C. for 60 minutes to form the intermediate material layer 1*a*. The intermediate material layer 1*a* was then coated with IP5700 available from Tokyo Ohka Kogyo Co., Ltd. at a thickness of 5 μm by spin coating and was baked at 90° C. to form the mask material layer 5*a* (see FIGS. 4A1 and 4A2).

Next, the portion of the mask 5 for forming the portion of the intermediate layer 1 corresponding to the channel wall member 9 was formed. The mask material layer 5*a* was continuously exposed in an i-line stepper (manufactured by Canon Kabushiki Kaisha) using the same mask for each liquid ejection head segment.

Next, the portion of the mask 5 for forming the portion of the intermediate layer 1 corresponding to the information symbol region was formed. The mask material layer 5*a* was exposed in a one-to-one relationship with the photomask in a projection exposure apparatus. The exposure gap between the photomask and the silicon substrate 12 was 60 μm.

Next, the mask material layer 5*a* was subjected to development using a developer (NMD-3 (trade name) available from Tokyo Ohka Kogyo Co., Ltd.) to form the mask 5 having the fourth outer end surfaces 16 and the third outer end surfaces 6. The fourth angle E was about 90°, and the third angle D was about 110° (see FIGS. 4B1 and 4B2). The third outer end surfaces 6 were formed so as to form the contours of numbers corresponding to the positions of the liquid ejection head segments in the wafer, one of which was the number "10". The intermediate material layer 1*a* was then etched by reactive ion etching (RIE) using the mask 5, and the resist was removed with a remover (1112A (trade name) manufactured by ROHM Co., Ltd.) to form the intermediate layer 1 (see FIGS. 4C1 and 4C2). The first angle θ was about 110°, and the second angle ϕ was about 90°. The first outer end surfaces 3 were formed so as to form the contours of the numbers corresponding to the positions of the liquid ejection head segments in the wafer.

Next, the surface of the substrate 12 on which the intermediate layer 1 was formed was coated with a positive photoresist (ODUR (trade name) available from Tokyo Ohka Kogyo Co., Ltd.) for forming a template for the channels 14 at a thickness of 14 μm by spin coating and was subjected to exposure and development to form a template for the channels 14. To form the channel wall member 9, the following composition was further applied by spin coating to form a coating (not shown) having a thickness of 25 μm such that it covered the entire intermediate layer 1, including the first outer end surfaces 3 and the second outer end surfaces 7:

Epoxy resin: EHPE-3150 (available from Daicel Chemical Industries, Ltd.) 100 parts by mass Cationic photoinitiator: SP-172 (available from Adeka Corporation) 6 parts by mass Xylene 100 parts by mass The coating was subjected to exposure in an i-line stepper and development using a mixture of 60% xylene and 40% methyl isobutyl ketone (MIBK) and was cured in an oven at 140° C. for 60 minutes to form the orifices 11. Supply ports (not shown) were then formed in the silicon substrate 12 by anisotropic etching.

Next, the template for the channels 14 was removed with methyl lactate to form the channels 14 (see FIG. 2A).

Finally, the substantially circular substrate 12 was divided into a plurality of liquid ejection head chips by dicing.

When the information symbol region of one of the resulting liquid ejection heads was observed by microscopy through the channel wall member 9 in the direction from the orifice side to the substrate side, the first outer end surfaces 3 could be recognized as forming the contours of the number "10".

EXAMPLE 2

Liquid ejection heads were fabricated in the same manner as in Example 1 except that polyimide was used for the intermediate material layer 1*a* for forming the intermediate layer 1 instead of the polyetheramide used in Example 1. When the information symbol region was observed in the same manner as in Example 1, the first outer end surfaces 3 could be recognized as forming the contours of the number "10".

As described above, the adhesion strength between the channel walls and the substrate can be increased by forming end surfaces nearly perpendicular to the surface of the substrate in the portions of the intermediate layer opposite the channels. On the other hand, information about the liquid ejection head can be easily recognized and identified by forming inclined surfaces making an obtuse angle with the surface of the substrate in the region for displaying the information about the liquid ejection head. Thus, a liquid ejection head reliable and easy to check for corresponding information can be formed with a simple structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-168044 filed Jul. 27, 2010, which is hereby incorporated by reference herein in its entirety.

What is claimed is:

1. A liquid ejection head comprising:

a substrate having an energy-generating device configured to generate energy used for ejecting a liquid from an orifice;

a transparent channel wall member forming an inner wall of a channel leading to the orifice; and an intermediate layer disposed between and in contact with a surface of the substrate and the channel wall member and having a refractive index different from a refractive index of the channel wall member;

wherein the intermediate layer has a first outer end surface forming contours of a symbol as viewed in a direction from the orifice toward the substrate and making a first angle with the surface of the substrate and a second outer end surface facing the channel and making a second angle with the surface of the substrate, the first angle being an obtuse angle, the second angle being smaller than the first angle.

2. The liquid ejection head according to claim 1, wherein the channel wall member comprises a cured epoxy resin, and the intermediate layer comprises a thermoplastic resin.

3. The liquid ejection head according to claim 1, wherein the channel wall member and the intermediate layer each comprise an inorganic compound.

4. The liquid ejection head according to claim 1, wherein the first angle is 100° to 115°, and the second angle is 85° to less than 100°.

5. The liquid ejection head according to claim 1, wherein a region on the substrate surrounded by the first outer end surface has the shape of the symbol.

6. The liquid ejection head according to claim 1, wherein a portion of the intermediate layer having the first outer end surface has the shape of the symbol.

7. The liquid ejection head according to claim 1, further comprising a transparent surrounding member surrounding the channel wall member and having a refractive index different from the refractive index of the intermediate layer, the intermediate layer being disposed between and in contact with the surface of the substrate and the surrounding member, the first outer end surface being covered by the surrounding member.

8. The liquid ejection head according to claim 1, wherein the symbol corresponds to information about the liquid ejection head.

9. A method for producing a liquid ejection head including a substrate having an energy-generating device configured to generate energy used for ejecting a liquid from an orifice; a transparent channel wall member forming an inner wall of a channel leading to the orifice; and an intermediate layer disposed between and in contact with a surface of the substrate and the channel wall member and having a refractive index different from a refractive index of the channel wall member;

the method comprising the steps of:

preparing a substrate having a surface on which an intermediate material layer used for forming the intermediate layer and a mask material layer used as a mask for etching the intermediate material layer are disposed in the stated order;

forming a mask from the mask material layer, the mask having a third outer end surface forming contours of a symbol as viewed in a direction from above the mask toward the substrate and making a third angle with the surface of the substrate and a fourth outer end surface facing a region corresponding to the channel and making a fourth angle with the surface of the substrate, the third angle being an obtuse angle, the fourth angle being smaller than the third angle; and etching the intermediate material layer using the mask to form an intermediate layer having a first outer end surface forming the contours of the symbol and making a first angle with the surface of the substrate and a second outer end surface facing the channel and making a second angle with the surface of the substrate, the first angle being an obtuse angle, the second angle being smaller than the first angle.

10. The method for producing the liquid ejection head according to claim 9, wherein the intermediate layer has a first outer end surface forming contours of a first symbol and a first outer end surface forming contours of a second symbol different from the first symbol, the method further comprising a step of dividing the substrate between the first outer end surface forming the contours of the first symbol and the first outer end surface forming the contours of the second symbol.

11. The method for producing the liquid ejection head according to claim 9, wherein the symbol corresponds to information about the liquid ejection head.

* * * * *